US008505760B2

(12) United States Patent
Ott

(10) Patent No.: US 8,505,760 B2
(45) Date of Patent: Aug. 13, 2013

(54) FLAT SELF-OPENING CLOSURE FOR COMPOSITE PACKAGINGS OR FOR CONTAINER NOZZLES OR BOTTLE NECKS TO BE CLOSED BY FILM MATERIAL

(75) Inventor: Gregor Ott, Basadingen (CH)

(73) Assignee: SIG Technology Ltd., Neuhausen am Rheinfall (CH)

( * ) Notice: Subject to any disclaimer, the term of this patent is extended or adjusted under 35 U.S.C. 154(b) by 117 days.

(21) Appl. No.: 13/182,021

(22) Filed: Jul. 13, 2011

(65) Prior Publication Data

US 2012/0181281 A1 Jul. 19, 2012

Related U.S. Application Data

(63) Continuation-in-part of application No. 11/718,993, filed as application No. PCT/CH2005/000644 on Nov. 4, 2005, now abandoned.

(30) Foreign Application Priority Data

Nov. 15, 2004 (CH) ..... 1875/04

(51) Int. Cl.

| | |
|---|---|
| ***B65D 17/42*** | (2006.01) |
| ***B65D 41/04*** | (2006.01) |
| ***B65D 47/10*** | (2006.01) |
| ***B67D 1/00*** | (2006.01) |

(52) U.S. Cl.
USPC ..... 220/277; 220/278; 215/253; 222/81; 222/83; 222/541.5; 222/541.6; 222/153.14

(58) Field of Classification Search
USPC ..... 220/277, 278, 258.1; 222/541.2, 222/91, 541.5, 541.6, 153.14, 153.16, 153.05, 222/153.15, 81, 83; 215/329, 252, 257, 253; 229/125.24, 125.04
See application file for complete search history.

(56) References Cited

U.S. PATENT DOCUMENTS

| | | | | |
|---|---|---|---|---|
| 6,279,779 | B1 * | 8/2001 | Laciacera et al. | 222/83 |
| 7,178,683 | B2 * | 2/2007 | Birkmayer et al. | 215/257 |
| 7,207,465 | B2 * | 4/2007 | Weist | 222/83 |
| 7,458,486 | B2 * | 12/2008 | Weist et al. | 222/83 |
| 7,490,736 | B2 * | 2/2009 | Moulton | 222/83 |

* cited by examiner

*Primary Examiner* — Robin Hylton
(74) *Attorney, Agent, or Firm* — Edwin D. Schindler

(57) ABSTRACT

A self-opening closure includes a pouring sport, a screw cap and a self-opening cylinder, which is disposed inside the pouring spout and can be set rotating by the screw cap. The self-opening cylinder has three combined piercing and cutting elements with the interior having three molded elements, evenly distributed and extending toward the center of the cylinder, which have a nail shank and a nail head. The nail shank and the nail head of each element acts as a guide for one of the three cylinder wall segments located on the interior of the cap, concentrically to the axis of rotation of the cap. The screw cap is connected to a retaining element by at least two material bridges extending non-radially in relation thereto that are configured as predetermined breaking points. The retaining element engages with a flange on the pouring spout.

11 Claims, 4 Drawing Sheets

Figure 1:
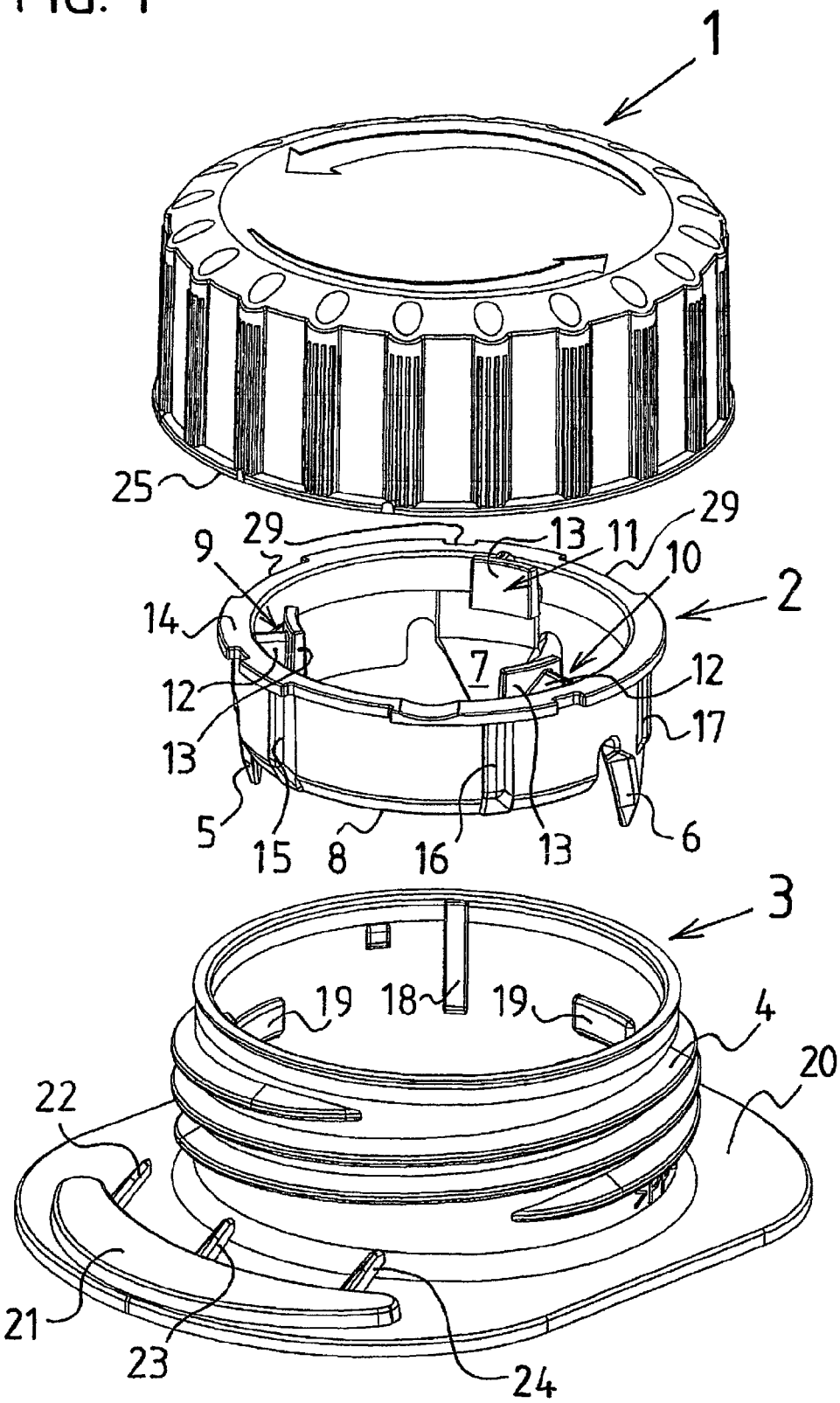

FLAT SELF-OPENING CLOSURE FOR COMPOSITE PACKAGINGS OR FOR CONTAINER NOZZLES OR BOTTLE NECKS TO BE CLOSED BY FILM MATERIAL

CROSS-REFERENCE TO RELATED APPLICATIONS

This is a continuation-in-part of U.S. patent application Ser. No. 11/718,993, filed May 29, 2007 now abandoned, which represents the U.S. National Phase patent application of P.C.T. Application No. PCT/CH2005/000644, filed Nov. 4, 2005, the entire disclosure of which shall be deemed to be incorporated by reference herein.

BACKGROUND OF THE INVENTION

1. Technical Field of the Invention

This invention relates to a flat self-opening closure for combipacks as well as for containers and bottle nozzles of all kinds that are to be sealed with sheeting. This especially includes the liquid packings in the form of such combipacks that are made up of foil-laminated paper, in which liquids like milk, fruit juices, other non-alcoholic drinks or also general liquids of the non-food variety are packed. The closure can also be used for combipacks, in which, free-flowing substances, like sugar, powder, a variety of chemicals or similar substances, are stored or packed. This foil-laminated paper is a laminated substance, similar to paper or board web coated with a plastic such as polyethylene and/or aluminum. Normally, the volumes of such packings range from 20 cl to up to two liters or more. Alternatively, the self-opening closure can also be mounted on the containers, such as bottles made of glass or plastic or similar containers which are sealed by a sheeting. Such seals made up of plastic are available in various designs. When meant for a combipack, they form a pouring nozzle with a shoulder protruding radially from its lower edge, which forms a locking flange at this pouring nozzle. The nozzle is threaded externally, on which a threaded cap can be tightened as the closure. Such a self-opening closure is flanged on to the combipack by welding or sticking to the combipack with the lower side of its protruding edge i.e. with the lower side of its flange. The free passage at the lower end of the nozzle is thereafter blocked by the paper and the dense foil of the combipack. In case of a bottle, the pouring nozzle can be screwed or mounted on the mouth of the bottle and on the inside it can be sealed with a foil membrane. The nozzle is threaded on the outside, on which a threaded cap can then be tightened as the closure.

The foil-reinforced paper, passing below the welded or the stuck nozzle or the foil membrane, fastened within the nozzle must be cut, torn open or pressed out for opening, so that the passage is made clear and the liquid or the free-flowing substance can be poured out of the container through the nozzle. For this, a tube is arranged within the nozzle, which is pressed axially downward when the cap is rotated and thereafter starts rotating in the direction of rotation. The lower end of the tube is provided with one or more piercing or cutting teeth. In this way, the tube is meant to cut out a disc of the foil-reinforced paper or the foil membrane running below it, owing to its axial downward and subsequent rotational movement.

2. Description of the Prior Art

The common self-opening closure comprises of a pouring nozzle, which can be mounted tightly on a combipack or on a container- or a bottle nozzle, which is to be sealed by a foil, a related rotating cap and a self-opening tube arranged within the pouring nozzle, which can be set in motion by the rotating cap. The latest designs have a self-opening tube with at least one individually combined piercing or cutting element at its lower end and away from it. This self-opening tube, the pouring nozzle, as well as the rotating cap, are provided with guides and force transmitters, which coordinate with one another in such a manner that when the rotating cap is rotated for the first time in the direction of opening, the self-opening tube can be pushed first in the pouring nozzle axially downward without rotation and can then be rotated on its axis without any axial movement.

However, if the self-opening tube shows only one individually combined piercing and cutting element, then the tube must have a specific length proportionate to its diameter, which permits its stable guiding in the pouring nozzle in the axial direction, so that tilting is definitely avoided. This necessitates a corresponding overall height of the self-opening closure. Moreover, the self-opening closure must be designed to be relatively sturdy and stable, in order to absorb the reaction forces that originate from a single piercing and cutting element. The guaranteed first opening of such a closure is mostly ensured by installing a safety seal at the lower end of the cap over a number of pre-determined breaking points, whereby the safety seal then bounces over a bulge at the pouring nozzle during the first mounting. For opening the cap for the first time, a great number of individual breaking points must be broken at the same time, which necessitates a correspondingly higher force.

SUMMARY OF THE INVENTION

The basic function of this self-opening closure is to achieve an essentially flatter and simpler design with a lower overall height, whereby the self-opening tube opens unfailingly despite the foil and the tilting. Moreover, the self-opening closure would require less plastic material because of its smaller overall height. In a special design, apart from this, the self-opening closure should offer a guaranteed first opening, which is easier to realize for the user of the closure. This first opening guarantee should also be designed flatter and easier i.e. by using less synthetic material.

This basic function is fulfilled by a flat self-opening closure for combipacks, as well as for containers or bottle nozzles, to be sealed with sheeting, comprising of a pouring nozzle, which can be fixed tightly on a combipack or on a container- or bottle nozzle, to be sealed with sheeting, a related rotary cap as well as a self-opening tube arranged within the pouring nozzle, which can be rotated by this rotary cap, in which connection the self-opening tube has a combined piercing and cutting element at its lower end and is away from it, and is characterized by the fact that the self-opening tube shows, in its interior, toward the center of the tube, protruding nail-shaped arrangements with a nail shaft and nail head. The nail shaft and the lower side of the nail head are meant as guides for cylindrical wall segments arranged concentric to the rotating axis of the cap on the inner side of the cap lid, which form an angular profile running at an acute angle to the lower side of the lid and a thrusting face running vertical to the lid surface, connected to this. The special design of the first opening guarantee arises from the dependant claims.

BRIEF DESCRIPTION OF THE DRAWING FIGURES

The figures show a favorable design of this self-opening closure for combipacks in different views. With the help of these figures, the self-opening closure is described below in detail and its function is explained.

Figure 2:
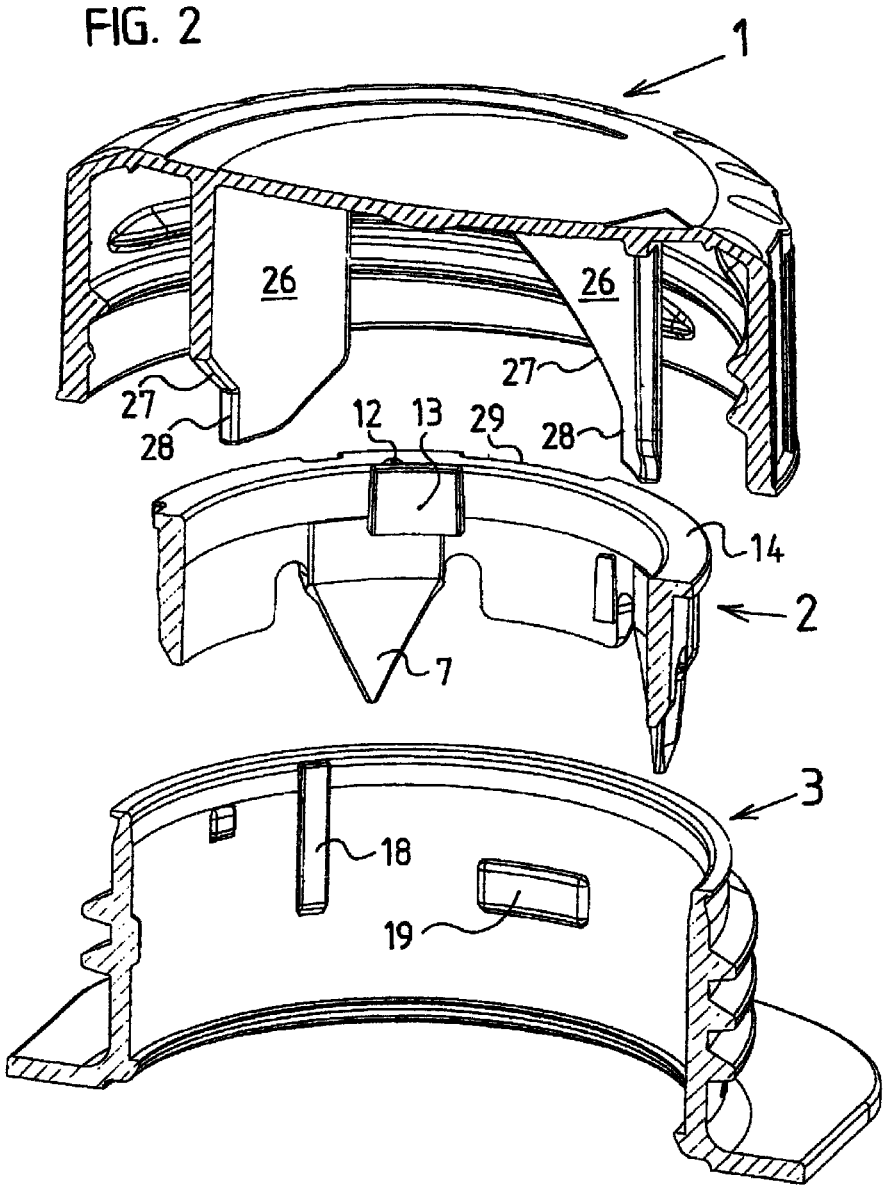
Figure 3:
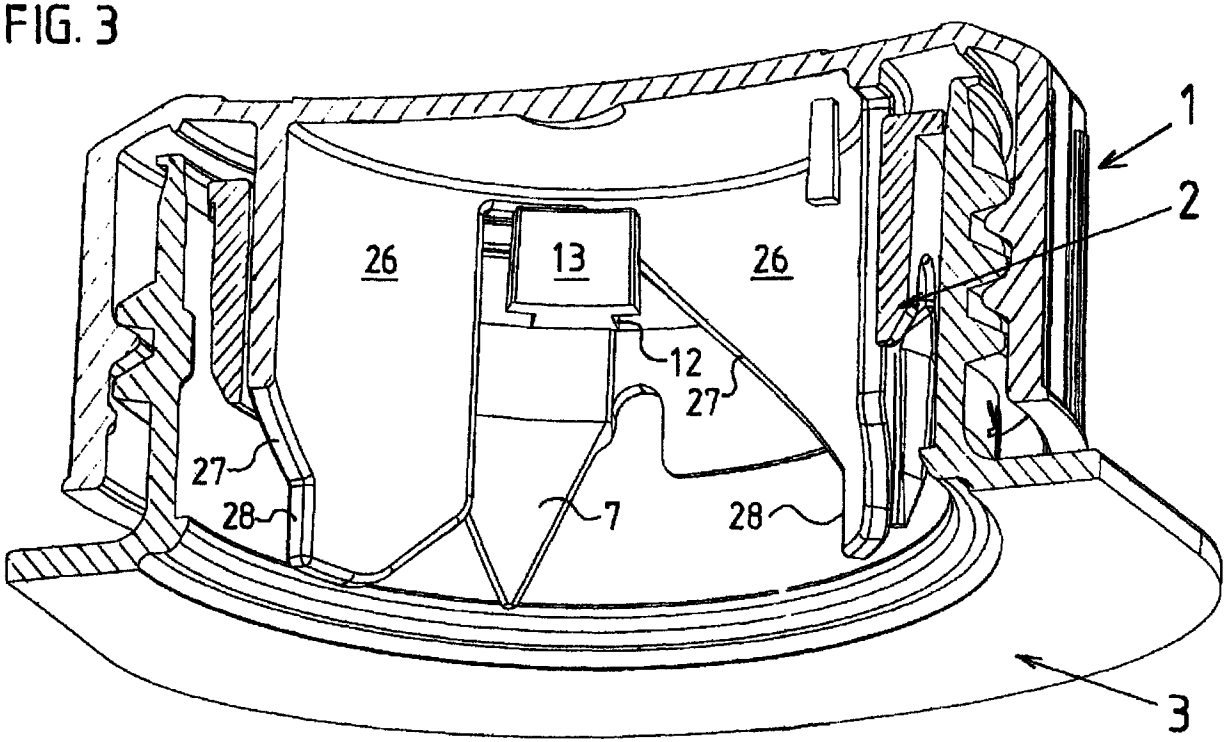

One can see the following:

FIG. 1: The self-opening closure with its three components in the knocked-down condition in a perspective representation;

FIG. 2: The self-opening closure with its three components in the knocked-down condition in a perspective representation, but with a sectional representation of the individual components;

FIG. 3: The self-opening closure in the assembled state in a perspective representation, in a sectional view; and, FIG. 4: The holding element is shown prior to being downwardly placed onto the pouring nozzle flange with bolts of the holding element being insertable into complementary holes of the flange.

DETAILED DESCRIPTION OF THE DRAWING FIGURES AND PREFERRED EMBODIMENTS

FIG. 1 shows the self-opening closure with its three components in knocked-down condition as seen in perspective, whereby the view is diagonal from the top. On the top one can see the rotary cap 1, in the middle the self-opening closure 2 and at the bottom the pouring nozzle 3. The rotary cap 1 is designed as a threaded cap and accordingly provided with an inner threading, which fits the outer threading 4 at the pouring nozzle 3. The self-opening closure 2 shows, as the first essential feature three combined piercing and cutting elements 57 at its lower end and distant from it. Two of these piercing and cutting elements, namely the piercing and cutting elements 5 and 6 lie diametrically opposed, while the third piercing and cutting element 7 is formed between 85° and 100° of the circumference of the self-opening closure, away from both the other piercing and cutting elements 5 and 6 at its lower end 8.

Further, the self-opening tube 2 shows nail-shaped projections 9, 10, 11, arranged uniformly and distributed along its circumference and protruding to the center of the tube with nail shaft 12 and nail head 13. The actual nail shaft 12 of each of these projections 9-11 as well as the lower side of the respective nail head 13 acts as guide and forces transmission elements for three cylinder wall segments arranged concentric to the rotating axis of the cap at the inner side of the lid, which become visible in another representation of cap 1. At the upper edge, the self-opening closure 2 shows a slightly projecting edge 14, from whose outer side clearances 29 are available over certain sections of the circumference. At the outer wall of the self-opening closure 2, axially running ridges 15-17 are formed. These interact with the corresponding axial ridges 18 and horizontal ridges 19 at the lower side of the pouring nozzle 3, which shall be explained later.

One can see the flange 20 at the pouring nozzle 3. Here, on the front side of the flange 20 lies an element 21, which is locked on to the flange 20 with the help of bolts on its lower side. The flange 20 has bolt-passing holes in which the bolts are tightened. At this element 21, one can make out three fine material bridges 22-24, which are arranged parallel to one another, so that at least both the outer ones 22, 24 do not run radial to the pouring nozzle 3. Originally, that is at the mounted closures, these material bridges 22-24 are connected in one piece with the lower edge 25 of the cap 1. The self-opening tube 2 is used for mounting the closure in the correct rotating position in the pouring nozzle 3 and hereafter the cap 1, together with the element 21 formed at it through the material bridges 22-24, is fixed at the thread 4 of the pouring nozzle 2 and the element 21 is pressed hereafter with its bolts at its lower side in the holes of the pouring nozzle flange 20.

If hereafter the cap 1 is rotated in the opening direction i.e. in the counter-clockwise direction when seen from the top, as shown with the help of arrows at the upper side of the cap, first the fine material bridges 22-24 are broken. Because these material bridges 22-24 are arranged parallel to the pouring nozzle and all are not radial, they do not break at the same time. At first, the material bridge 24 becomes taut and breaks, followed by the middle material bridge 23 and finally the material bridge 22. Owing to this sequential breaking of the material bridges 22-24, force required is less than in the case of the solutions till now, which necessitated the simultaneous breakage of a lot of material bridges. For this reason, even the older and the weaker people can easily break this first-use guarantee. In one version, the middle material bridge 23, arranged here radially to the nozzle, can be perforated mechanically, so that at the finished closure only both of the outer material bridges 24 and 22 need to be broken one by one after rotating the cap 1.

In FIG. 2, one can see the self-opening closure with its three components in a disassembled condition in a perspective representation. Here, each of the three components are shown in an axial representation, namely in an axial section. Contrary to FIG. 1, one can see here parts of the three cylinder wall segments 26, arranged concentric to the rotating axis of the cap at the inside of the lid. All these cylinder wall segments 26 show a bevel 27 running at an acute angle to the lower side of the lid, to which a thrusting edge 28 vertical to the lower side of the lid connects. In case of a composite closure and when the rotary cap 1 is rotated in the counter-clockwise direction, this bevel 27 acts on the nail shaft 12 of the nail-shaped formation 11 at the inner wall of the self-opening tube 2. The same also applies to the bevels 27 of the other two cylinder wall segments 26. Because the cylinder wall segments 26 are designed as the nail-shaped projections 9-11, they cannot deviate through a bending toward inside. This design through the projections 9-11 enables that the cylinder wall segments 26 are essentially thinner and hence can be designed in a lighter form than the previous designs.

Owing to the guiding ridges at the outer side of the self-opening tube 2 as well as those at the inner side of the pouring nozzle 3, the self-opening tube 2 cannot rotate, but can only move axially downward. When the rotary cap 1, seen from the top, is rotated in the counter-clockwise direction, it moves downward and is thus pushed axially downward in the pouring nozzle 3, whereas the bevels 27 slide over the shafts 12 of the nail-shaped projections 9-11, until the thrusting edges 28 are stopped at the nail shafts 12.

Thereby, the self-opening tube 2 is pushed down axially as far as that it now lies with its upper edge 14 below the axial ridges 18. The horizontal ridges 19 can be passed from the upper edge 14 of the self-opening tube 2, because the clearances 29 in this edge face the horizontal ridges 19. In the course of this axial downward push of the self-opening tube 2, its three piercing and cutting elements 5-7 perforate a foil running below it. When the cap 1 is rotated further in the loosening direction, the self-opening tube 2 is not pushed down axially further, but rotates horizontally. Thereby, the three piercing and cutting elements 5-7 cut out a section in the foil in the counter-clockwise direction along the length of the circumference of the pouring nozzle 3, and that too at an angle of about 120.degree. Approximately over this range of rotation, the threaded cap 1 is loosened further on the pouring nozzle 3 and thereby moves upward, so that the cylinder wall segments 26 lie over the projections 9-11 and their thrusting edges 28, these projections 9-11 do not further rotate them and as a result the self-opening closure 2. Because the two piercing and cutting elements 5 and 6 are arranged 180.degree. apart from one another, they leave a piece of the foil uncut along the circumference of the pouring nozzle 2, when the self-opening tube 2 is rotated at around 120.degree. The foil is folded toward inside in the pouring nozzle exactly around this intact piece and continues to hang in the opening, without falling into the packing.

FIG. 3 shows an axial section of the closure in assembled condition. One can see here, how the cylinder wall segments 26, which are arranged down at the lid of the threaded cap 1, interact with the nail-shaped projections 9-11, of which only the projection 11 is visible here. If, starting from this position, the lid cap 1 is moved in the direction of loosening, the diagonally running face 27 pushes on the nail shaft 12 of the adjacent projection 11. The self-opening tube 2 cannot rotate along with this and is pushed downward as a result, whereby the piercing and the cutting elements 5-7, of which only the piercing and cutting element 7 is visible here, pierce the foil lying below it. This movement continues, till the rotary cap 1 has rotated so far and has also moved axially upward, till the vertical face 28 is present at the nail shaft 12 of the projection 11. Because the self-opening tube 2 was moved axially downward, it can now rotate horizontally and accordingly upon further rotation of the rotary cap 1 it is rotated further by the thrusting edges 28 in the counter-clockwise direction as seen from top, as a result of which the piercing and cutting elements 7-9 almost completely cut out a circular piece from the foil, which they perforated earlier, which, in the end phase of the rotation, is folded downward.

Figure 4:
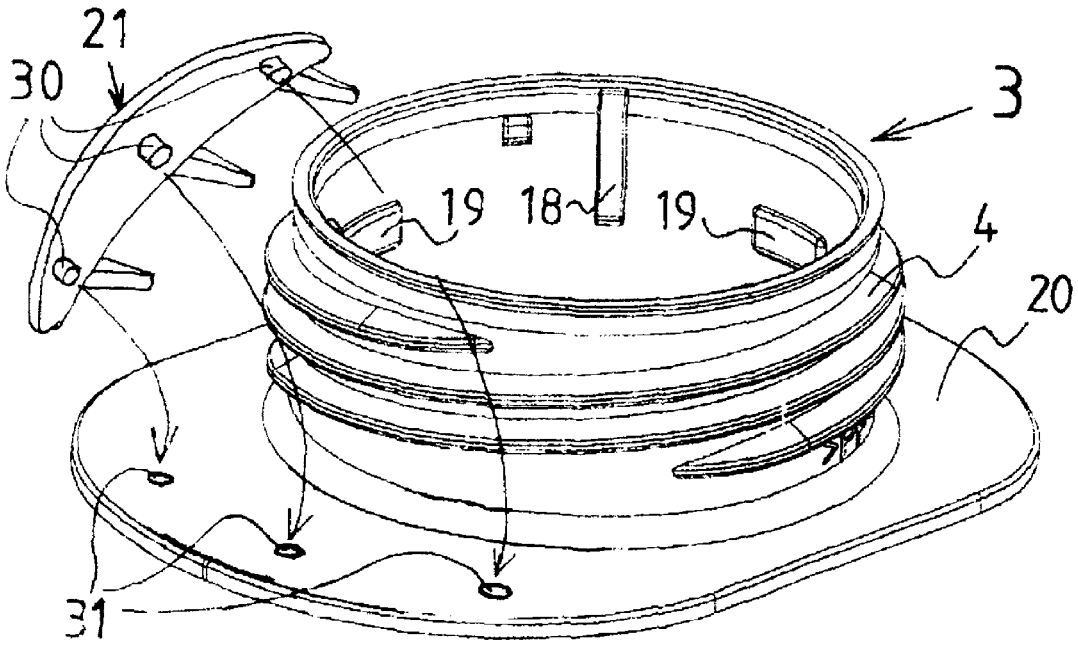

FIG. 4 shows a plurality of bolts 30 on the holding element 21 and an associated plurality of holes 31 in the flange 20 of the pouring nozzle 3. The holding element 21 is shown prior to being downwardly placed onto the pouring nozzle flange 20 with bolts 30 of the holding element 21 being insertable into the complementary holes 31 of the flange 20.

This self-opening closure is characterized by an especially flat construction. The nail-shaped projections 9, 10, 11, present on the inside in radial direction, make it possible to construct the self-opening tube 2 in an especially light and low design. Still, it is guided reliably in the axial direction, because the shafts 12 and the nail heads 13 of the nail-shaped projections 9, 10, 11 act as guides, when the rotary cap 1 gets engaged with the downward-directed cylinder, wall segments 26 at these projections 9, 10, 11. The self-opening tube 2 can be comparatively so low that the ratio of its height, without the piercing and cutting elements 5-7, to its inner diameter is only 1:3, or else, together with the piercing and cutting elements 5-7, just 1:2. The complete overall height of the composite closure including the lid cap 1, self-opening closure 2 and pouring nozzle 3 is in the ratio of just 3:5 to the inner diameter of the pouring nozzle 3. This, therefore, produces a very flat self-opening closure 2, which also manages with less material and correspondingly having less weight owing to the filigree design yet being fully functional.

While only several embodiments of the present invention have been shown and described, it will be obvious to those skilled in the art that many modifications may be made to the present invention without departing from the spirit and scope thereof.

What is claimed is:

1. A flat self-opening closure for a container, comprising:

a pouring nozzle fixable on a container to be sealed with sheeting;

a rotary cap having a cap lid and cylinder wall segments arranged concentrically to a rotating axis of said rotary cap at an inner side of said cap lid; and, a self-opening tube within said pouring nozzle able to be rotated via said rotary cap, said self-opening tube having, at a lower edge, combined piercing and cutting elements and further including nail-shaped projections at an inner side of said self-opening tube, said nail-shaped projections each having a nail shaft and a nail head extending toward a central point of said self-opening tube, each said nail shaft and a lower side of each said nail head being guides for said cylinder wall segments having a bevel running at an acute angle to a lower side of said cap lid to which a thrusting edge, vertical to said lower side of said cap lid, connects, so that when said rotary cap is rotated, said bevel acts on a respective said nail shaft of a respective said nail-shaped projection at an inner wall of said self-opening tube.

2. The self-opening closure for a container according to claim 1, further comprising means for providing a first-use indicator of opening said container.

3. The self-opening closure for a container according to claim 2, wherein said means for providing a first-use indicator of opening said container includes connecting said rotary cap to a plurality of material bridges, running non-radially and acting as reference breaking points, having a holding element joined at a lower side to said flange of said pouring nozzle.

4. The self-opening closure for a container according to claim 3, wherein said lid cap is extruded with said holding element as a unity element through at least two parallel-running material bridges of said plurality of material bridges for connecting said holding element with a lower edge of said lid cap.

5. The self-opening closure for a container according to claim 4, wherein said lid cap is extruded with said holding element as a unity element through three of said parallel-running material bridges for connecting said holding element with said lower edge of said lid cap with one parallel-running material bridge of said parallel-running material bridges being a central parallel-running material bridge and with said central parallel-running material bridge being perforated.

6. The self-opening closure for a container according to claim 3, wherein said holding element has at said lower side at least one vertically-arranged bolt for fitting into an associated hole in said flange of said pouring nozzle.

7. The self-opening closure for a container according to claim 1, wherein said self-opening tube has three said combined piercing and cutting elements individually located at two opposite points on a circumference of said self-opening tube and at one point between said two opposite points, said self-opening tube further having three said nail-shaped projections, each with one said nail shaft and one said nail head at an inner side of said self-opening tube, uniformly distributed along said circumference and extending toward a central region of said self-opening tube, each said nail shaft and a lower side of each said nail head acting as guides for three said cylinder wall segments arranged concentrically to said rotating axis of said lid cap on said inner side of said cap lid.

8. The self-opening closure for a container according to claim 1, wherein a ratio of height of said self-opening tube, without said combined piercing and cutting elements, to an inner diameter of said self-opening tube is 1:3.

9. The self-opening closure for a container according to claim 1, wherein said nail-shaped projections are three radially distant projections at said inner side of said self-opening tube, each radially distant projection of said three radially distant projections having a nail shaft and a nail head.

10. The self-opening closure for a container according to claim 1, wherein said self-opening tube has an outer wall with multiple axially running ridges formed thereon, coordinating with axial ridges on an inner wall of said pouring spout for protection against tilting.

11. The self-opening closure for a container according to claim 1, wherein a ratio of height of said self-opening closure, when assembled, including said lid cap, said self-opening tube and said pouring nozzle to an inner diameter of said pouring nozzle is 3:5.

* * * * *